United States Patent [19]

Shepherdson

[11] Patent Number: 4,776,581

[45] Date of Patent: Oct. 11, 1988

[54] EXERCISE APPARATUS

[76] Inventor: Donalda G. Shepherdson, 2492 Calle de Pescadores, Alpine, Calif. 92001

[21] Appl. No.: 889,827

[22] Filed: Jul. 24, 1986

[51] Int. Cl.[4] ..... A63B 5/10

[52] U.S. Cl. ..... 272/65; 272/69; 272/71; 272/73; 272/900

[58] Field of Search ..... 272/69–73, 272/93, 116, 65, 134, 900, 1 B; 4/488, 494, 496

[56] References Cited

U.S. PATENT DOCUMENTS

| | | | |
|---|---|---|---|
| 3,047,294 | 7/1962 | Maxwell | 272/65 |
| 3,142,485 | 7/1964 | Jacobsen . | |
| 3,226,114 | 12/1965 | Swider . | |
| 3,427,022 | 2/1969 | Ward . | |
| 3,485,213 | 12/1969 | Scanlon | 272/69 X |
| 3,584,870 | 6/1971 | Garst . | |
| 3,639,921 | 2/1972 | Siler | 4/494 |
| 3,641,601 | 2/1972 | Sieg | 272/70 X |
| 3,837,643 | 9/1974 | Lee | 272/65 |
| 3,900,489 | 5/1975 | Smith . | |
| 3,913,907 | 10/1975 | Baker . | |
| 3,988,020 | 10/1976 | Carter . | |
| 4,071,236 | 1/1978 | Oprean . | |
| 4,074,904 | 2/1978 | Arcidiacono . | |
| 4,149,712 | 4/1979 | Murphy . | |
| 4,300,759 | 11/1981 | Caplan . | |
| 4,311,306 | 1/1982 | Solloway . | |
| 4,332,217 | 6/1982 | Davis | 272/69 X |
| 4,548,405 | 10/1985 | Lee et al. | 272/65 X |

FOREIGN PATENT DOCUMENTS

| | | | |
|---|---|---|---|
| 2347062 | 12/1977 | France | 272/73 |
| 2658825 | 7/1978 | Fed. Rep. of Germany | 4/496 |
| 2818020 | 11/1979 | Fed. Rep. of Germany | 272/73 |
| 1020677 | 2/1966 | United Kingdom | 272/65 |

*Primary Examiner*—Richard J. Apley
*Assistant Examiner*—Robert D. Bahr
*Attorney, Agent, or Firm*—Hughes, Cassidy, & Multer

[57] ABSTRACT

Exercise apparatus for promoting flexibility, strength, and an efficient cardiovascular system at modest cost and without the stress appurtenant to such common forms of exercise as jogging, running, and conventional aerobics. The apparatus includes a tank or other receptacle designed to be filled with an aqueous fluid providing resistance to movements by the user and an exercise device in and attached to the tank which the user can employ to generate the appropriate movements.

5 Claims, 3 Drawing Sheets

EXERCISE APPARATUS

This application is a continuation of copending application Ser. No. 536,383, filed Sept. 27, 1983, now abandoned.

The present invention relates to exercise apparatus and, more particularly, to novel improved apparatus capable of providing such important benefits as increased flexibility and strength, conditioning of the cardiovascular system, and weight control. A concomitant benefit of the foregoing is an accompanying improvement in mind and spirit.

Briefly, my novel exercise apparatus includes a receptacle or tank designed to be filled with water and housing a device such as a trampoline or other rebounder, a treadmill, or an exercycle for exercising the muscles and cardiovascular system of the user. The water provides increased resistance to movement, promoting the development of muscular tissue and promoting a rapid increase in heart rate. At the same time, this is done without stressing or otherwise traumatizing muscles and joints as running, jogging, conventional aerobics and the like do. This eliminates the damage that stress can cause such as hip, knee, and foot problems; shin splints; etc. Moreover, the foregoing benefits are realized without the large pool required for swimming, the exercise which perhaps most closely resembles those I have developed in so far as its benefits are concerned.

Variations may of course be made in the invention as briefly described above. For example, a filter may be employed to insure that the quality of the water remains high; and the water may be heated to promote reductions in body fat and produce other therapeutic benefits such as blood vessel dilation (which increases circulation and reduces blood pressure).

Devices which take advantage of the resistance offered by water to the movement of a human body are not unknown. Such devices are shown, for example, in U.S. Pat. Nos.: 3,142,485 issued July 28, 1964 to Jacobsen; 3,226,114 issued Dec. 28, 1965, to Swider; 3,427,022 issued Feb. 11, 1969, to Ward; 3,584,870 issued June 15, 1971, to Garst; 3,913,907 issued Oct. 21, 1975, to Baker; 3,988,020 issued Oct. 26, 1976, to Lyle; 4,071,236 issued Jan. 31, 1978 to Oprean; 4,074,904 issued Feb. 21, 1978, to Arcidiacono; 4,149,712 issued Apr. 17, 1979, to Murphy; 4,300,759 issued Nov. 17, 1981, to Caplan; and 4,311,306 issued Jan. 19, 1982, to Solloway. In no case, however, do these prior art exercising devices provide the benefits of my invention as described above. With the exception of the patents to Murphy, Caplan, and Solloway, those identified above appear to be nothing more than devices for training swimmers by a technique akin to that involving the use of weighted shoes to train runners. The other three prior art patents identified above by name seem to be nothing more than body building devices; unlike my invention, they apparently have nothing to do with increasing joint flexibility or with cardiovascular circulation, for example.

From the foregoing it will be apparent to the reader that the primary object of the present invention resides in the provision of novel, improved exercise apparatus.

A related, primary and also important, object of my invention resides in the provision of novel improved exercise apparatus for improving flexibility, muscular strength and cardiovascular conditions, thereby generating an overall improvement of body, mind, and spirit.

Other also important, but more specific, objects of the invention reside in the provision of exercise apparatus in accord with the preceding objects:

in which water is used as a resistance medium to make the benefits discussed above available rapidly and to a maximum extent;

which makes the benefits discussed above available without imposing on the person using the apparatus the stress imposed on joints and muscles by jogging, running, aerobic, and other conventional exercise;

which can be furnished at a reasonable cost;

which eliminates the space and other problems appurtentant to other exercising apparatus such as swimming pools and complicated muscle building equipment Other important objects and features and additional objects of the invention will become apparent to the reader from the foregoing, from the appended claims, and from the ensuing detailed discussion and description of my invention taken in conjunction with the accompanying drawing in which:

Figure 1:
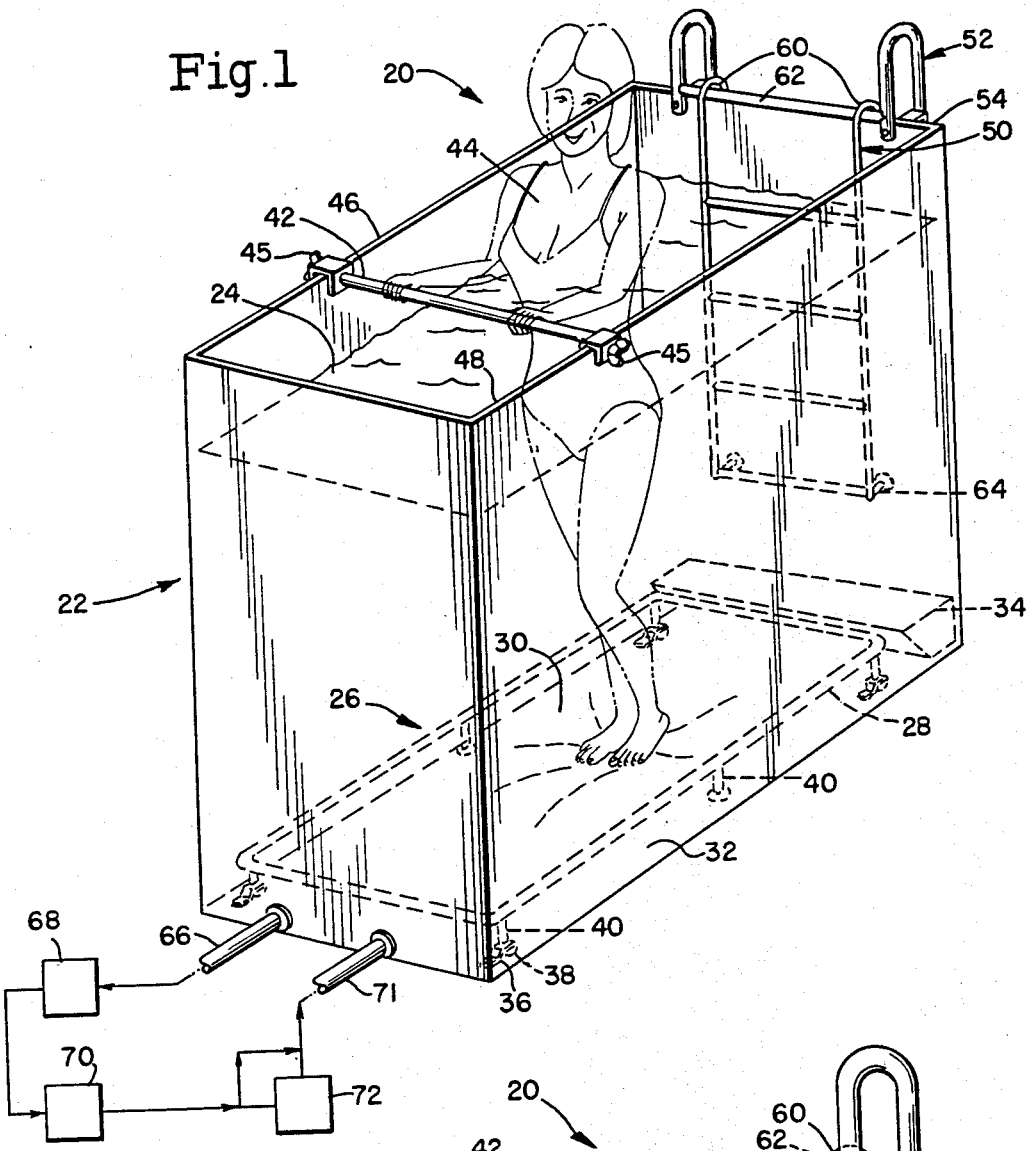
FIG. 1 is a pictorial view of exercise apparatus embodying the principles of the present invention.
Figure 2:
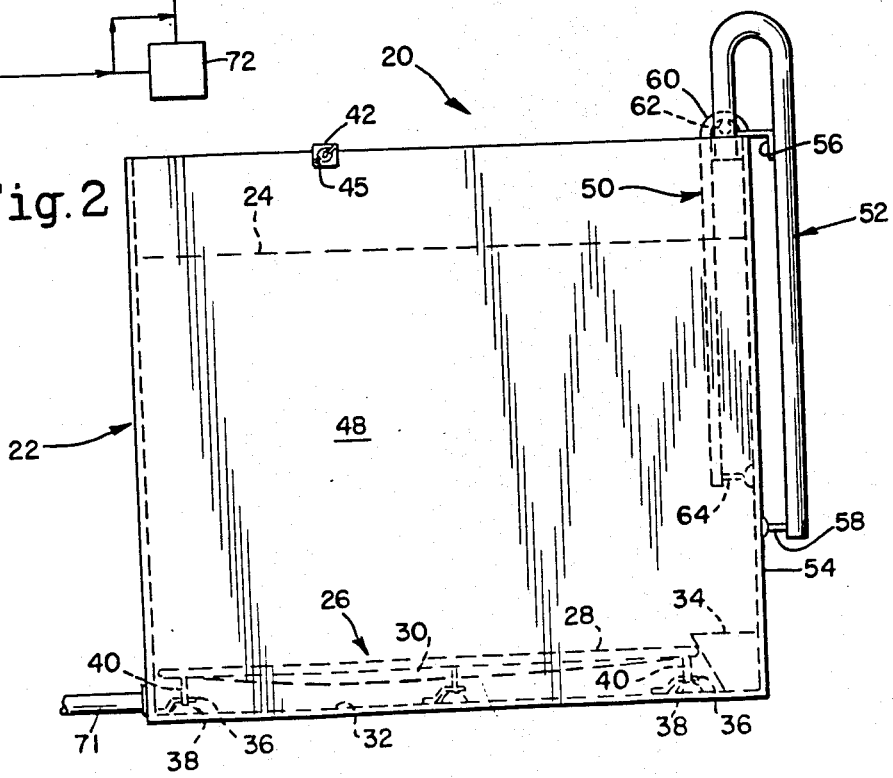
FIG. 2 is a side view of the exercise apparatus shown in FIG. 1.

Referring now to the drawing, FIGS. 1 and 2 depict exercise apparatus 20 constructed in accord with and embodying the principles of the present invention.

Among the major components of exercise apparatus 20 is a tank 22 which has an open top and is intended to be filled with water to at least waist and preferably breast level (the water level is indicated by reference character 24 in FIG. 1). Tank 22 may be fabricated of any suitable material including fiberglass and stainless steel.

A second major component of apparatus 20 is a rebound type exercise device 26. This component includes a rigid frame 28 and a member 30 which is elastically deformable in a vertical direction as is best shown in FIG. 2.

Exercise device 26 is secured to the floor 32 of tank 22 by a retaining block 34 and by retaining clips 36. The latter are fixed to tank floor 32, and they extend over tips 38 at the lower ends of legs 40 which depend from exercise device frame 28.

Another major component of exercise apparatus 20 is a handhold or bar 42 which the user 44 of the exercise apparatus can employ to help maintain his or her balance in the apparatus. Handhold 42, which extends between the side walls 46 and 48 of tank 22, can be positioned at any location preferred by exercise apparatus user 44 by loosening and tightening wing nuts 45.

Exercise apparatus 20 also includes ladders 50 and 52 at the rear wall 54 of tank 22. As best shown in FIG. 2, ladder 52 is fixed to the rear tank wall 54 by a bracket 56 toward its upper end and has legs 58 at its lower end which space that end of the ladder from tank 22.

Removable ladder 50 has hooks 60 at its upper end. These are engagable with a rung 62 of ladder 52, and they cooperate with legs 64 at the lower end of ladder 50 to support it from tank 22 and ladder 52.

Water with which tank 22 is filled is withdrawn from that tank through outlet 66 by pump 68 and circulated to and through a filter 70 and back into the tank through inlet 71 to keep the water clean. The water can also be circulated through a heater 72 to increase the temperature of the water in tank 22 and thereby promote the burning of body fat and better blood circulation.

Salt rather than fresh water may be employed, if desired, to provide the benefits which immersion in ocean water is well-known to produce. Also, sulphur, lithium, Epsom salts and other minerals with therapeutic properties can be added to the water.

Other variations that can be made in the apparatus shown in FIG. 1 include the substitution of a rebounder with a spring system instead of or in addition to an plastic member, for the illustrated exercise device and the substitution of a gas-filled and therefore elastically deflectable component for the rebounder.

Figure 3:
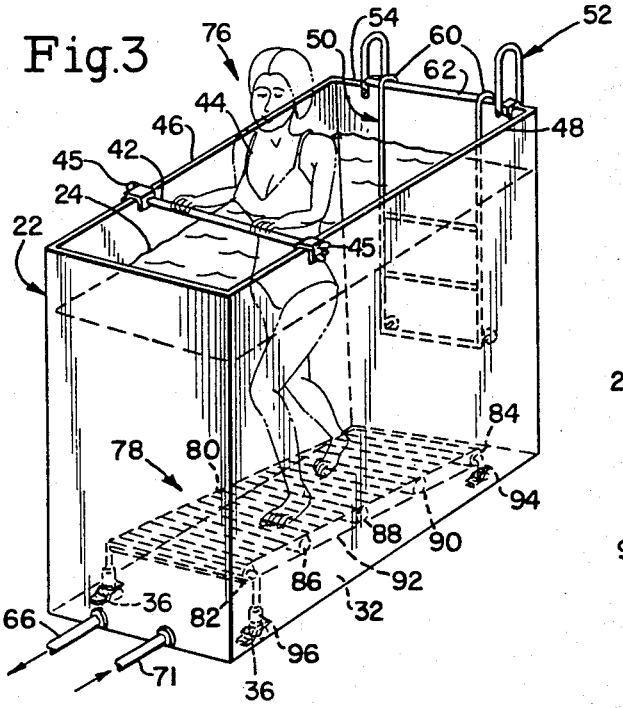
FIG. 3 is a pictorial view of a second form of exercise apparatus in accord with the principles of the present invention.
Figure 4:
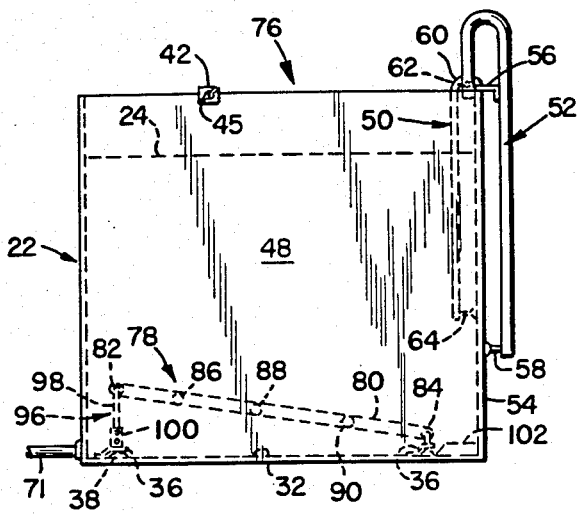
FIG. 4 is a side view of the exercise apparatus illustrated in FIG. 3.

Referring again to the drawing, FIGS. 3 and 4 depict exercise apparatus 76 which differs from that shown in FIGS. 1 and 2 primarily in that a treadmill rather than rebounder type exercise device (78) is employed. To the extent that exercis apparatus 76 and exercise apparatus 22 are alike, the same reference characters have been employed to identify those components which may be the same.

As best shown in FIG. 3, exercise device 78 includes an endless belt or tread 80 trained around end rollers 82 and 84 and over intermediate rollers 86, 88, and 90. The several rollers 82 through 90 are rotatably supported from a frame 92. The frame is in turn supported from the floor 32 of tank 22 by fixed length legs 94 and adjustable length legs 96 which have an internally threaded upper member 98 and an externally threaded lower member 100. Legs 96 permit the inclination of tread 80 to be adjusted to meet the needs and capabilities of the person using the exercise apparatus.

A retaining block 102 and retaining clips 36 fix exercise device 78 to the floor 32 of exercise apparatus 76 in a manner akin to that discussed above in conjunction with apparatus 20.

Figure 5:
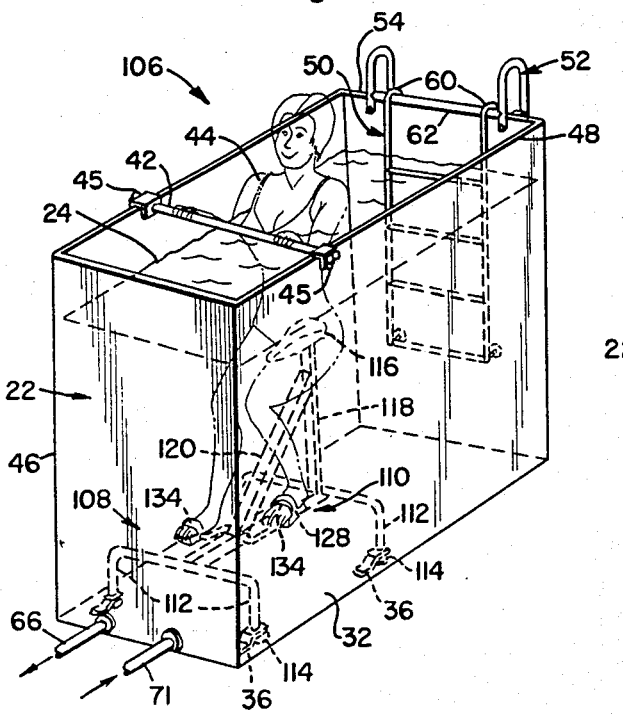
FIG. 5 is a pictorial view of a third form of exercise apparatus employing the principles of the invention.
Figure 6:
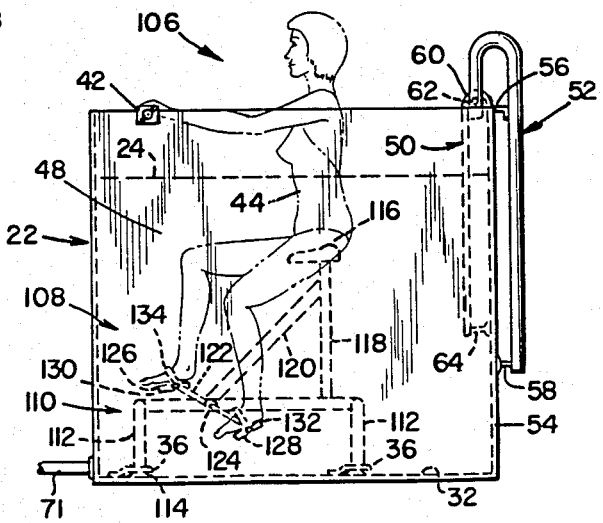
FIG. 6 is a side view of the exercise apparatus illustrated in FIG. 5.

FIGS. 5 and 6 depict yet another form of exercise apparatus (106) embodying the principles of my invention. This apparatus differs from those discussed above primarily in that it employs a cycle type excrcise device (108) rather than the rebound (or trampoline) type shown in FIG. 1 or the treadmill type illustrated in FIGS. 3 and 4. Again, like reference characters have been employed to identify components of exercise apparatus 106 which are like those of apparatus 22 and apparatus 76.

Referring now specifically to FIGS. 5 and 6, the cycle type exercise device 108 referred to above includes a tubular frame 110 with depending legs 112 terminating in tips 114. Clips 36 extending over legs 112 and engaging tips 114 secure exercise device 108 to the floor 32 of tank 20.

A seat 116 for the user 44 of exercise apparatus 106 is supported from frame 110 by a vertically extending post 118 and a brace 120 connected between the latter and frame 110. A double-armed crank 122 is also supported from frame 110, in this case by a shaft 124 which allows the crank to rotate relative to frame 110. Pedals 126 and 128 are pivotally supported from the extremities of crank 122 by shaftlike crank portions 130 and 132 at those extremities.

Straps 134 attached to the pedals keep the rider's feet from slipping off them.

Figure 7:
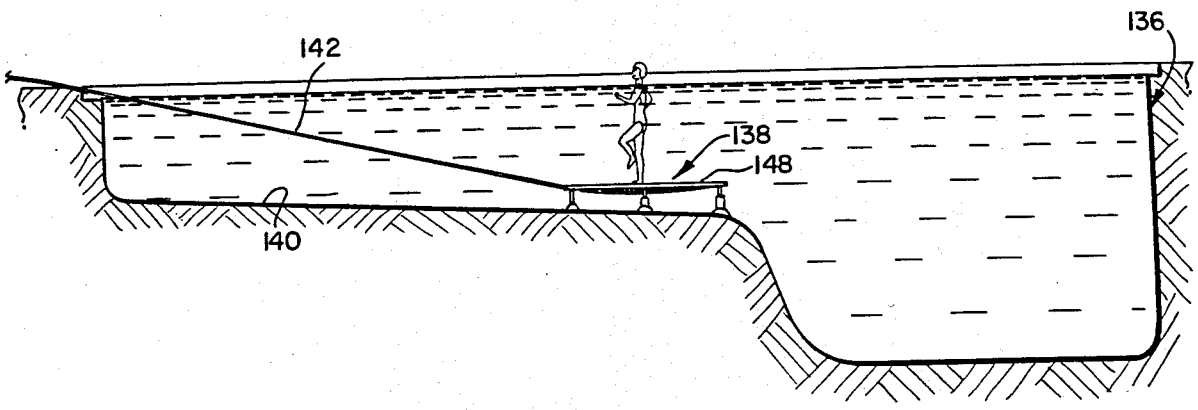
FIG. 7 is a pictorial view showing how the benefits of the invention can be realized in a conventional swimming pool.
Figure 8:
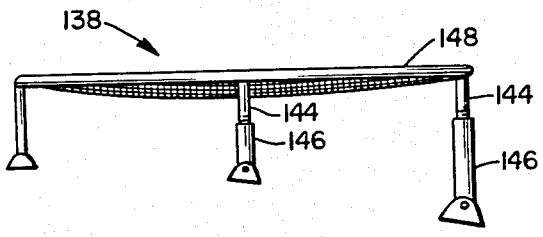
FIG. 8 is a generally schematic side view of a rebound type exercise device that can be employed in applications as shown in FIG. 7.
Figure 9:
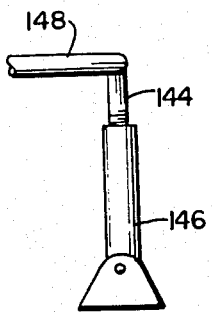
FIG. 9 shows in more detail one leg of the exercise device illustrated in FIG. 8.

Referring again to the drawing, FIG. 7 illustrates how the principles of my invention may be applied to a conventional swimming pool 136. Specifically, in the application of my invention shown in that figure, a rebound or trampoline type exercise device 138 is positioned at a specified location along the floor 140 of pool 136 by a tether 142 connected between the exercise device and an appropriate support (not shown). Preferably, a device having legs with one component 144 threaded into a second component 146 will be employed. This permits the length of those legs to be adjusted so that the rebounding surface 148 of the exercise device will be level as shown in FIG. 7.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent of the United States is:

1. Exercise apparatus for increasing the flexibility and strength, conditioning the cardiovascular system, controlling the weight of, and otherwise benefiting, a human user, said exercise apparatus comprising: a tank or other receptacle which has a horizontal floor and vertically extending side walls and is designed to contain an aqueous fluid, said receptacle being sufficiently large to accommodate a human user in an erect position and to contain sufficient fluid to reach at least the waist of a human in that position; an exercise device housed in said receptacle and adapted to be submerged in the fluid with which said receptacle is filled, said exercise device being supported from, and secured relative to, the floor of the receptacle and comprising a frame and means which: (a) is supported from said frame above the floor of the receptacle with the lower part of said body of fluid between it and the receptacle floor, and (b) is elastically displaceable in vertical directions by the exertions of the human user of the exercise apparatus against the resistance offered by those bodies of liquid in the receptacle below and above said frame-supported means to benefit said user as aforesaid; means extending between the side walls of said receptacle and engageable by the hands of the user via which said user can stabilize the position of his or her body relative to said receptacle while exerting himself or herself to elastically displace said frame-supported means as aforesaid; means for so fixing said hands-engageable means to the side walls of the receptacle at the upper edges thereof that said means can be displaced to and located at different positions along said receptacle to thereby meet the needs of different users of said apparatus; and means for facilitating the ingress and egress of the user into and out of said receptacle, said receptacle having vertically extending front and rear walls and the means for facilitating the ingress and egress of the user comprising first and second, vertically extending ladders respectively mounted on the outside and inside of the rear wall of the exercise apparatus receptacle and means so supporting the second of said ladders from said receptacle rear wall that said ladder can be removed after the human user of the exercise apparatus has entered the receptacle of that apparatus to thereby eliminate any possibility that the user might be injured by said second ladder, said first ladder having a series of vertically spaced apart rungs, said second ladder having vertically extensible stanchions at the opposite sides thereof, and said ladder-supporting means comprising hooks which are located at the upper ends of said stanchions and are engageable over one of the rungs of the first ladder.

2. Exercise apparatus for increasing the flexibility and strength, conditioning the cardiovascular system, controlling the weight of, and otherwise benefiting, a human user, said exercise apparatus comprising: a tank or other receptacle which has a horizontal floor and vertically extending side walls and is designed to contain an aqueous fluid, said receptacle being sufficiently large to accommodate a human user in an erect position and to contain sufficient fluid to reach at least the waist of a human in that position; an exercise device housed in said receptacle and adapted to be submerged in the fluid with which said receptacle is filled, said exercise device being supported from, and secured relative to, the floor of the receptacle and said exercise device comprising a frame and means which: (a) is supported from said frame above the floor of the receptacle with the lower part of said body of fluid between it and the receptacle floor, and (b) is elastically displaceable in vertical directions by the exertions of the human user of the exercise apparatus against the resistance offered by the liquid in the receptacle to benefit said user as aforesaid; means extending between the side walls of said receptacle and engageable by the hands of the user via which said user can stabilize the position of his or her body relative to said receptacle while exerting himself or herself to elastically displace said frame-supported means as aforesaid; and means for so fixing said hands-engageable means to the side walls of the receptacle at the upper edges thereof that said means can be displaced to and located at different positions along said receptacle to thereby meet the needs of different users of said apparatus, said frame having depending legs spaced around its periphery and said apparatus further comprising: clip means fixed to the floor of the receptacle into which said legs can be slid to secure said frame to said floor and a retainer installable between one end of said frame and a vertically extending end wall of said tank to keep said frame legs from sliding out of said clips means.

3. Exercise apparatus as defined in claim 2 which includes means for facilitating the ingrees and egress of the user into and out of said receptacle, said receptacle having vertically extending front and rear walls and the means for facilitating the ingress and egress of the user comprising first and second, vertically extending ladders respectively mounted on the outside and inside of the rear wall of the exercise apparatus receptacle and means so supporting the second of said ladders from said receptacle rear wall that said ladder can be removed after the human user of the exercise apparatus has entered the receptacle of that apparatus to thereby eliminate any possibility that the user might be injured by said second ladder, said first ladder having a series of vertically spaced apart rungs, said second ladder having vertically extensible stanchions at the opposite sides thereof, and said ladder-supporting means comprising hooks which are located at the upper ends of said stanchions and are engageable over one of the rungs of the first ladder.

4. Exercise apparatus as defined in claim 2 which includes means for heating the aqueous fluid with which the receptacle is filled.

5. Exercise apparatus as defined in claim 2 which includes a filter and means for circulating the aqueous fluid with which said receptacle is filled to and through said filter and then returning said fluid to said receptacle.

* * * * *

UNITED STATES PATENT AND TRADEMARK OFFICE

CERTIFICATE OF CORRECTION

PATENT NO. : 4,776,581

DATED : October 11, 1988

INVENTOR(S) : Donalda G. Shepardson

It is certified that error appears in the above—identified patent and that said Letters Patent is hereby corrected as shown below:

On the title page, Items [19] and [76], Name of applicant:

"Shepherdson" has been changed to --Shepardson--.

In the Specification:

Column 3, line 20, after "salts" a "comma" has been inserted.

Column 3, line 25, "plastic" should read -- elastic --.

Column 3, line 59, "22" has been changed to - 20 --.

Column 3, line 66, "20" has been changed to - 22 --.

Signed and Sealed this

Nineteenth Day of December, 1989

*Attest:*

JEFFREY M. SAMUELS

*Attesting Officer* *Acting Commissioner of Patents and Trademarks*